US006279279B1

(12) United States Patent
Larimore

(10) Patent No.: US 6,279,279 B1
(45) Date of Patent: Aug. 28, 2001

(54) AERATED FLOORING SYSTEM

(76) Inventor: Mark Larimore, 3367 Walton Dr., Montgomery, AL (US) 36111

( * ) Notice: Subject to any disclaimer, the term of this patent is extended or adjusted under 35 U.S.C. 154(b) by 0 days.

(21) Appl. No.: 09/593,166

(22) Filed: Jun. 14, 2000

Related U.S. Application Data

(63) Continuation of application No. 09/131,229, filed on Aug. 7, 1998, now Pat. No. 6,101,775.
(60) Provisional application No. 60/076,708, filed on Mar. 4, 1998.

(51) Int. Cl.[7] ..... E04B 1/70
(52) U.S. Cl. ..... 52/302.1; 52/302.3; 52/403.1; 52/408; 52/1; 52/480; 52/745.05; 454/247
(58) Field of Search ..... 52/290, 302.1, 52/302.3, 403.1, 408, 287.1–506.04, 506.01, 480; 454/185, 186, 246, 247, 251

(56) References Cited

U.S. PATENT DOCUMENTS

| | | | | |
|---|---|---|---|---|
| 2,206,119 | * | 7/1940 | Persons | 52/302.3 X |
| 3,045,294 | * | 7/1962 | Livezey, Jr. | 52/403.1 |
| 3,636,725 | | 1/1972 | MacCracken . | |
| 3,827,202 | * | 8/1974 | Phillips | 52/290 X |
| 4,290,798 | | 9/1981 | Cebalo et al. . | |
| 4,507,901 | | 4/1985 | Carroll . | |
| 4,642,958 | | 2/1987 | Pewitt . | |
| 4,663,909 | * | 5/1987 | Ogino et al. | 52/302.3 |
| 4,879,857 | | 11/1989 | Peterson et al. . | |
| 4,888,927 | * | 12/1989 | Yoshimi et al. | 52/408 X |
| 4,945,697 | * | 8/1990 | Ott et al. | 52/403.1 |
| 5,297,992 | | 3/1994 | Bailey et al. . | |
| 5,299,401 | | 4/1994 | Shelton . | |
| 5,395,479 | | 3/1995 | Petino . | |
| 5,412,917 | * | 5/1995 | Shelton | 52/403.1 |
| 5,433,050 | | 7/1995 | Wilson et al. . | |
| 5,467,609 | | 11/1995 | Feeney . | |
| 5,468,184 | * | 11/1995 | Collier | 454/186 |
| 5,526,621 | * | 6/1996 | Shelton | 52/302.1 |
| 5,642,967 | | 7/1997 | Swain et al. . | |
| 5,673,964 | | 10/1997 | Roan et al. . | |
| 5,694,723 | * | 12/1997 | Parker | 52/169.5 |
| 5,709,767 | | 1/1998 | Petino . | |
| 5,966,881 | * | 10/1999 | Kitagaki | 52/293.3 |

OTHER PUBLICATIONS

Brochure by Action Floor Systems, Inc., 1997.*
Brochure entitled "Scissor–Loc Air Flow" by Superior Floor Company, Inc., Mar. 1998.*
Brochure entitled "Scissor–Loc Air Flow" by Superior Floor Company, Inc., published prior to Mar. 1998.
Brochure by Action Floor Systems, Inc., Spring 1997.

* cited by examiner

*Primary Examiner*—Beth A. Stephan
*Assistant Examiner*—Brian E. Glessner
(74) *Attorney, Agent, or Firm*—Brobeck, Phleger & Harrison

(57) ABSTRACT

The invention relates to an aerated flooring system for use in athletic arenas or gymnasiums. The flooring system includes a top layer that provides a surface for the activities to be conducted on the floor. The system also includes at least one ventilation device. The ventilation device covers an air flow shaft within the flooring system, helping to prevent debris from falling in the air flow shaft, but allowing air to flow through the ventilation device. The ventilation device allows air to ventilate out of the flooring system. A support layer below the top layer provides support to the flooring system. A ventilation layer below the flooring is sized to allow air movement through the layer. The air flow shafts allow air to travel from the ventilation layer to the ventilation device. A base is below the ventilation layer and provides support for the flooring system above. A blowing device is controlled by a computer system that monitors the system using sensors. The blowing device can provide air circulation through the flooring system by creating air flow through the ventilation layer, through the air flow shafts, into the ventilation device, and out the flooring system. The aerated flooring system can also be adapted to existing conventional flooring systems without the need to tear up and remove the old flooring.

13 Claims, 15 Drawing Sheets

AERATED FLOORING SYSTEM

REFERENCE TO RELATED APPLICATIONS

This application is a continuation of U.S. utility patent application, Ser. No. 09/131,229, filed Aug. 7, 1998, now U.S. Pat. No. 6,101,775 and claims priority from provisional patent application, Ser. No. 60/076,708, filed Mar. 4, 1998.

BACKGROUND OF THE INVENTION

1. Field of the Invention

The present invention relates to flooring systems and, especially, aerated flooring systems suitable for use in athletic arenas and gymnasiums.

2. Description of the Background

Conventional flooring uses a plurality of layers composed of different types of materials. The materials and the design of the structure support the weight of the floor itself and objects intended to be placed on or supported by the floor. Such flooring is sometimes designed such that a minimal amount of space exists between the various layers and material components to provide increased strength.

A problem with these flooring systems is that they do not provide aeration and are susceptible to undesirable environmental conditions. For example, in a gymnasium or other athletic arena, the flooring system is subjected to high humidity, slab migration and water leaks caused by clogged plumbing, roof leaks or burst pipes in the walls or flooring, all of which can damage the flooring materials as well as the flooring system. Although a small amount of water may seem fairly innocuous, even small amounts of water and water vapor that persists in the floor can lead to rotting and the generation of distasteful odors or aromas. Larger amounts of water and high humidity cause structural and aesthetic damage to the flooring system as well as the surrounding area. Damage to these areas is difficult or impossible to detect, absent actual removal of the floor itself, and can result in unwanted expansion of the floor components (buckling), excessive contraction producing voids, deterioration, drastic shortening of the life of the component materials, and an often unexpected inability of the flooring to sustain any significant weight, resulting in, at best, structural damage and, at worst, personal injury. Structurally damaged areas are nearly always difficult and expensive to replace, often requiring installation of an entirely new flooring system.

Moreover, damp flooring also attracts insects such as termites and other creatures. These creatures often nest in damp areas of the flooring or subflooring, which becomes a long term habitat attracting and resulting in the proliferation of even more creatures.

One attempt to ventilate the subflooring of an athletic flooring system is described in U.S. Pat. No. 5,526,621. This flooring system requires a subflooring with a labyrinth design having spaces between the boards of the subfloor. This design is not adaptable with most conventional flooring systems, but requires complete replacement of an existing floor. Further, the system does not disclose the use of ventilation devices, but rather indicates that air can escape through conventional gaps which exist in the floor. Although the system includes a humidistat to detect higher than desirable humidity buildup, humidity is only detected if it persists at the exact location of the humidistat. There is no way to detect the location of humidity at other sites. Identifying the location of water and increased humidity is further complicated by the labyrinth design of the subflooring.

SUMMARY OF THE INVENTION

The present invention overcomes the problems and disadvantages associated with current flooring systems and provides an aerated flooring system with greater utility and functionality than is conventionally available. These flooring systems are adaptable to work with most existing flooring systems and to convert such existing systems into aerated flooring systems.

One embodiment of the invention is directed to aerated flooring systems comprising a top layer of flooring; a ventilation layer below the top layer, the ventilation layer being at least a size to allow for air to travel; at least one ventilation device; and an air flow shaft that allows air to travel from the ventilation layer to the at least one ventilation device. Preferably, the at least one ventilation device is placed at an end of the air flow shaft to help prevent debris from entering the shaft area. The at least one ventilation device comprises apertures to allow for air transfer.

Another embodiment of the invention is directed to methods for making an aerated flooring system out of an existing flooring system. These methods comprise connecting a blowing device to an existing flooring system which is capable of circulating air through the flooring. An air flow shaft may also be provided, which is capable of ventilating air out of the flooring system. Air is blown through a ventilation layer allows the air to travel completely through the system.

Another embodiment of the invention is directed to methods for making an aerated flooring system. These methods comprise laying a flooring base and a spacers above the base. A top layer can be laid above the spacers, wherein air can flow between the base and the top layer. An air flow shaft is provided above the base wherein air can flow through the air flow shaft. At least one ventilation device is installed above an end of the air flow shaft to help prevent debris from entering the shaft. The ventilation device may also comprise apertures to allow air transfer.

Another embodiment of the invention is directed to particular ventilation device of the flooring system, which is a vented cover flooring base. The vented cove base comprises a ventilation shaft which is at least of a size to allow for air to travel, an air flow aperture which is operable to release air and is directed in a direction to help prevent debris from falling into the air flow aperture, and a vented cove base operable connected to an edge of a floor and a wall.

Other embodiments and advantages of the invention are set forth, in part, in the description which follows and, in part, will be obvious from this description or may be learned from the practice of the invention.

DESCRIPTION OF THE INVENTION

Figure 1:
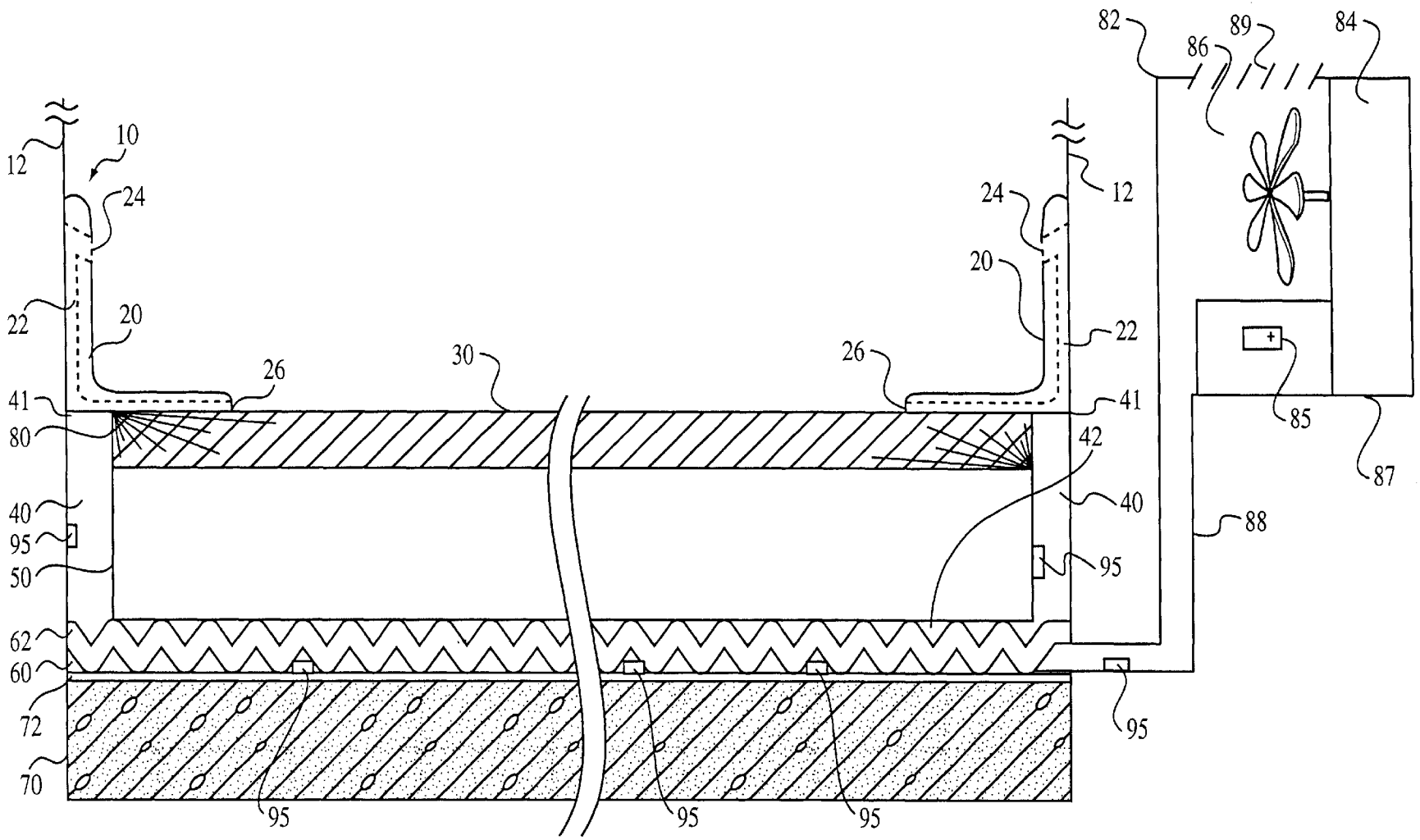
FIG. 1 Drawing of a side view of a flooring system.

As embodied and broadly described herein, the present invention is directed to flooring systems comprising an aeration system. These flooring systems provide a means for aerating the area between and below the flooring system while maintaining predetermined environmental conditions such as temperature, humidity and moisture levels within the floor and floor area.

Conventional flooring comprises a plurality of layers that structurally support the weight of the floor as well as the weight of objects to be supported by the floor. Typically, the design is such that a minimal amount of space exists between the various layers and material components thereby preventing any significant ventilation. Although structurally sound, the lack of aeration creates problems in regions of high humidity and in the event of more severe water damage.

It has been discovered that flooring can be created as a system that retains a structural soundness and ability to support any desired weight while providing floor and sub-floor aeration to prevent the harmful build up of water and water vapor. One advantage of this system is that the aerated flooring can be designed to maintain one or more desired environmental conditions such as humidity, temperature, and moisture content throughout and below the flooring system. To assist in controlling these conditions, the system can include one or more blowing devices, humidity sensors, temperature sensors, humidifiers, dehumidifiers, air conditioners, heaters, exhaust fans, lighting, modems, other environmental regulation mechanisms or combinations of such mechanisms. These one or more mechanisms can be connected through a designated control center such as, for example, a computer which may be controlled on-site or distally through the Internet, via modem, or another communications system.

Accordingly, another advantage of the invention is that the system can be automated. An automated system can use a plurality of sensors that accurately and efficiently monitor the environmental conditions of the entire flooring, or desired parts thereof, the surrounding area and/or the building conditions. These environmental conditions include, but are not limited to, temperature, humidity and moisture levels of the flooring. Twenty-four hour monitoring can observe the system in addition to providing alarms to indicate malfunctions or undesirable environmental conditions. Accordingly, the system may include an alarm system. Hardware to monitor the system, such as a control center, can be conveniently located in low profile areas such as, for example, under a gymnasium bleacher or another discrete location. Blowing devices, used to stabilize the humidity moisture and temperature, can be protected by secured housing and can use conventional blower parts, such as blades and air filters. Further, the automated system can be operated manually.

Another advantage of the aerated flooring system is that the system can be easily added to an existing floor. This allows users to adapt their current flooring system into an aerated system rather than replacing their entire existing flooring system which represents a substantial economic savings.

Another advantage of the aerated flooring system is that the subflooring is less susceptible to termites and other insects. By controlling the environmental conditions of the flooring system, insects are less likely to infest and damage the flooring. The system is also adaptable to sprayer devices to dispense insecticides, odor combatants, germicides, air freshening scents or any other chemicals determined necessary, above and/or below the flooring system.

Another advantage of the aerated flooring system is that the system can utilize most and likely all conventional materials presently used and commercially available in floors and flooring systems. The quality of the floor and the resiliency of the flooring system is unaffected. Thus, flooring systems can be aerated without a decrease in structural support.

One embodiment of the invention is directed to an aerated flooring system as depicted in FIG. 1 (the break in the middle of this figure as well as other figures indicates that the flooring system can be any desirable length). The aerated flooring system can be any desirable size and shape, but would typically be designed empirically on a room-by-room basis by one of ordinary skill in the art. There are no mechanical or structural restrictions which require specialized structures or types of materials. Accordingly, the flooring system can be used in any athletic arena, gymnasium, dance floor, aerobic floor, cotton mill, or any room, and the system can be in any residential, recreational, commercial or industrial building. Further, as a significant advantage of the invention is cost savings, aerated flooring systems of the invention are perfectly suited for non-profit institutions such as public schools and other institutions where finances are limited.

The aerated flooring system of the invention comprises a plurality of layers of supporting materials (FIG. 1). The supporting materials include, for example, a top layer of flooring 80 made of a flooring material such as wood, one or more ventilation devices 20 above top layer 80 such that the ventilation devices 20 help to prevent debris from entering into air flow shaft 40 and into the flooring system, a support layer 50 to withstand the rigors of expansion, contraction and depressions from the activities above the flooring system, a ventilation layer 60 to ventilate the flooring system 10, a flooring base 70 to support the weight of the flooring and the activities that occur above the flooring system, and a blowing device 82 which operates with an automated system 84 to regulate environmental conditions.

Top layer 80 can be made of any size or thickness that provides appropriate support for the intended use. Appropriate sizes can be determined by one of ordinary skill in the art based on the intended use and the component materials to be used. Top layer 80 has a top surface 30 that provides a surface for the activities to be conducted on the floor. Ventilation devices 20 can be attached to wall 12 and sit on top surface 30 so as not to stop proper expansion and/or contraction. Top layer 80 is preferably made of any conventional flooring material including, for example, rubber, stone or wood such as maple, pine, fir, redwood and oak, or synthetic material such as vinyl, linoleum, plastic, synthetic rubber or plaster, or a combination of one or more such materials. Top layer 80 can also be composed of a rubberized, elasticized or plastic material, for example, as used in wrestling arenas, but may be made of nearly any man-made or synthetic flooring material. Top layer 80 is connected to support layer 50 by adhesive, snaps, screws, hooks, staples, nails, clips or other conventional connecting means.

Figure 2A:
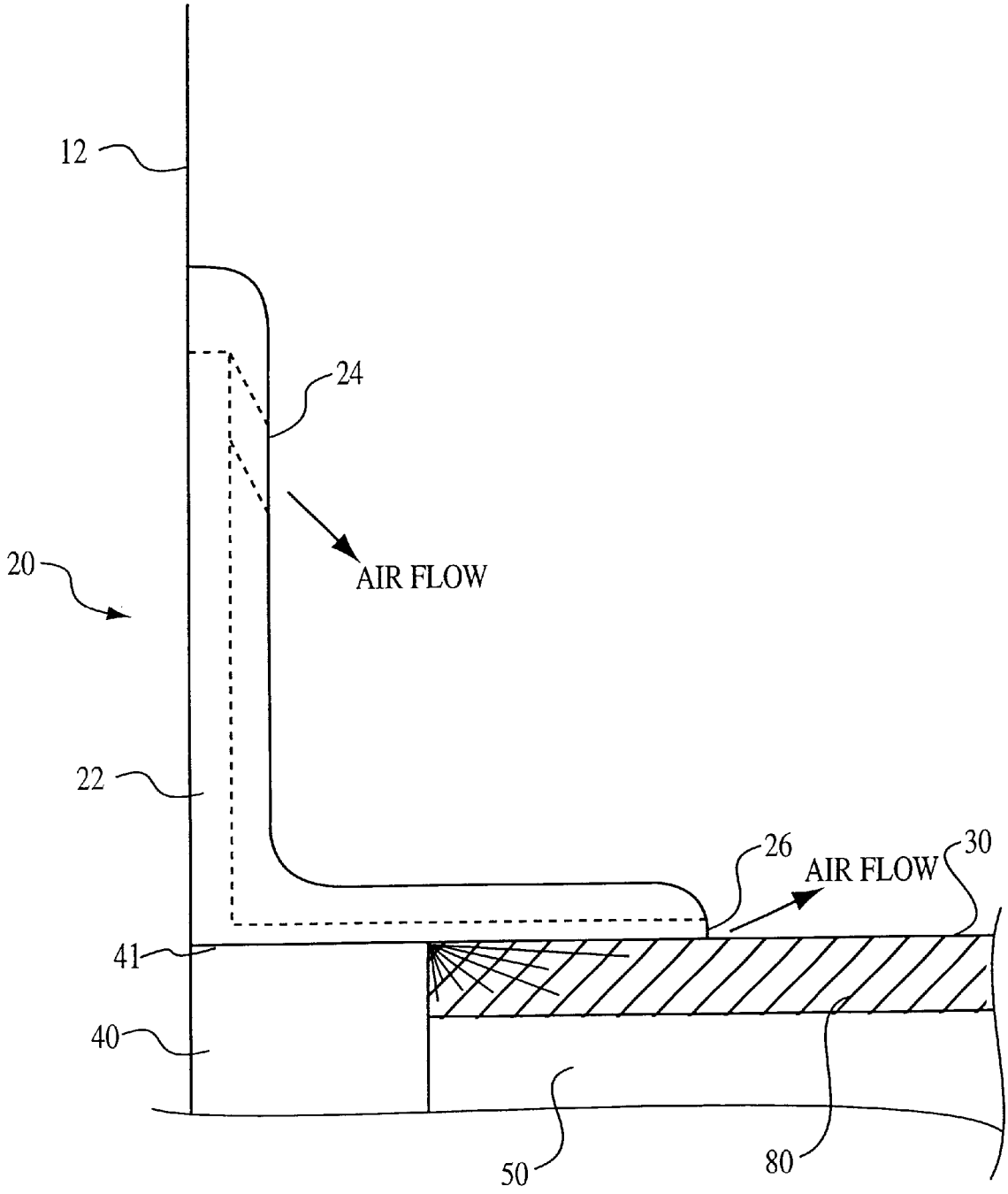
FIG. 2 Drawings of (A) a side view of a ventilation device, (B) a rear view of two connected ventilation devices, and (C, D, E) three alternative ventilation devices.

Ventilation device 20 is used to facilitate air removal from flooring system 10 and helps to prevent debris from falling into flooring system 10. Ventilation devices 20 can be placed at the edges of flooring system 10 or anywhere else within flooring system 10 such that ventilation device 20 facilitates air flow out of flooring system 10 and helps to prevent debris from falling into flooring system 10. An example of a suitable ventilation device 20 is depicted in FIG. 2A. FIG. 2A depicts a side view of ventilation device 20 according to one embodiment of the present invention. Ventilation device 20 depicted is a vented cove flooring base. Ventilation device 20 can be connected to additional ventilation devices 20 and Lo a support surface, such as wall 12. Ventilation device 20 can be in a substantially light angle shape, as depicted. Ventilation devices 20 can be placed all around top layer 80 such that the entire room could be surrounded with ventilation devices. Ventilation devices 20 could also be around any obstruction, such as pillars or columns in the middle of the room. Ventilation devices 20 can be connected to walls 12 or obstructions by adhesive, snaps, screws, hooks, nails, staples or other conventional connecting means. Alternatively, ventilation devices 20 can be placed where necessary for proper air flow without having to be around the entire room. Alternatively still, ventilation devices 20 can be placed a predetermined distance from walls 12, for example, near the middle of the floor.

Figure 2B:
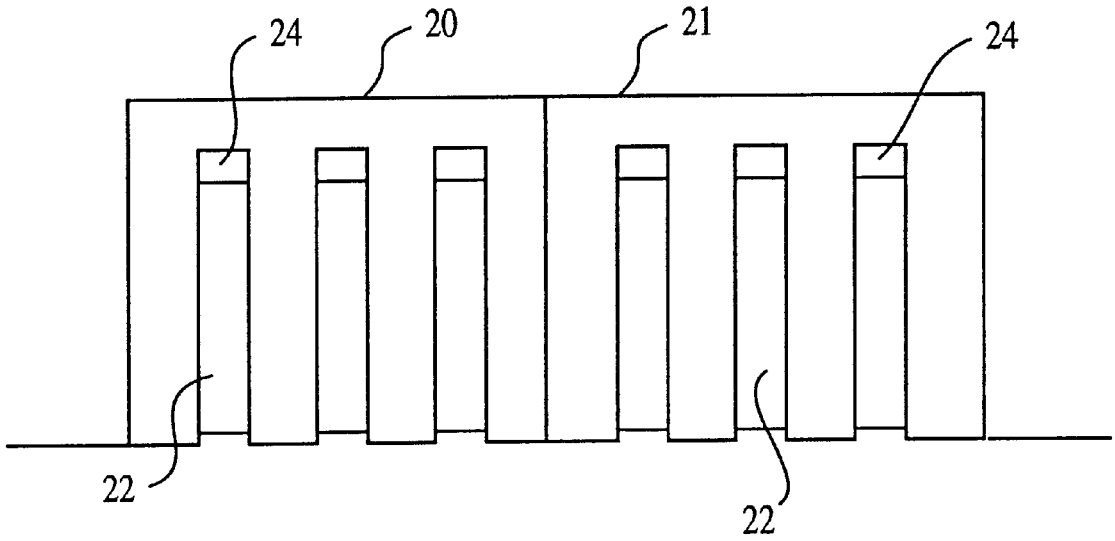

FIG. 2B depicts a rear view of two connected ventilation devices 20 and 21. Ventilation devices 20 and 21 depicted are vented cove flooring bases. In this depiction, ventilation device 20 is connected to ventilation device 21 by butting the devices together and connecting them with adhesive, snaps, screws, hooks, staples, nails, or other conventional connecting means. Alteratively, ventilation devices 20 and 21 can be butted together tightly without being connected in any other way. Alternatively still, ventilation device 20 can be connected to ventilation device 21 by including a tab on ventilation device 20 and inserting the tab into a notch on ventilation device 21. At corners, curved or right-angled ventilation devices could be used, or two ventilation devices could simply be connected together at an angle using any of the above mentioned connecting means.

Referring again to FIG. 2A, ventilation devices 20 can include one or more air flow apertures 24 and/or 26. Apertures 24 and 26 can be directed in any desired direction that helps prevent debris from falling into apertures 24 and 26. As depicted in FIGS. 2A and 2B, aperture 24 is on the upper part of ventilation device 20 and is directed downward, while aperture 26 is at the bottom of ventilation device 20 and is directed across top surface 30 of top layer 80, making it extremely difficult for dirt and other debris to enter apertures 24 and 26. Ventilation devices 20 also include at least one ventilation shaft 22 on its bottom and/or backside. Apertures 24 and 26 allow air to be released from ventilation devices 20. As shown in FIG. 2B, each ventilation device 20 could easily have three or more ventilation shafts 22 on its bottom and sides. However, ventilation devices 20 could have any number of ventilation shafts 22. Further, ventilation device 20 could have any number of apertures 24 and 26. Ventilation shafts 22 and apertures 24 and 26 permit air to exit from beneath, and/or in, and/or around the flooring system.

Referring again to FIG. 1, ventilation devices 20 cover air flow shaft 40 at the end 41 of air flow shaft 40, allowing air to travel through ventilation device 20 and helping to prevent debris from entering into air flow shaft 40. Air flow shaft 40 allows air to circulate into and out of flooring system 10. Although air flow shaft 40 is depicted as being next to wall 12, air flow shaft 40 can be placed nearly anywhere within the flooring system such as, for example, as shown in FIG. 2E. Air blown in the flooring system can flow through air flow shaft 40 and out through ventilation devices 20.

Ventilation devices 20 are preferably comprised of a hard rubber, wood, plastic or another natural or man-made product suitable for use in gymnasiums or athletic arenas. Such materials provide resilience and strength, but offer a safer surface to the user. Ventilation devices 20 can rest on top surface 30 of top layer 80, as seen in FIG. 2A. Ventilation devices 20 can be connected to a wall 12 and/or the top surface 30 of top layer 80 by adhesive, snaps, hooks, staples, nails, or other conventional connecting means. Alternatively, ventilation devices 20 can be built into top layer 80 so that it is produced as one piece, similar to that depicted in FIG. 2E.

In addition to facilitating air release, ventilation devices 20 also cover air flow shafts 40 at ends 41 of air flow shafts 40. By covering ends 41 of air flow shaft 40, ventilation devices 20 help prevent debris and other material from accidentally falling through into air flow shaft 40, but still allow air to flow through ventilation devices 20. Debris such as junk, loose change, dirt, and other objects are prevented from falling into ends 41 of air flow shaft 40 by ventilation devices 20. Accordingly, ventilation devices 20 can be any device that facilitates air release and helps to prevent debris or other material from falling into the openings in the top layer of the floor.

Figure 2C:
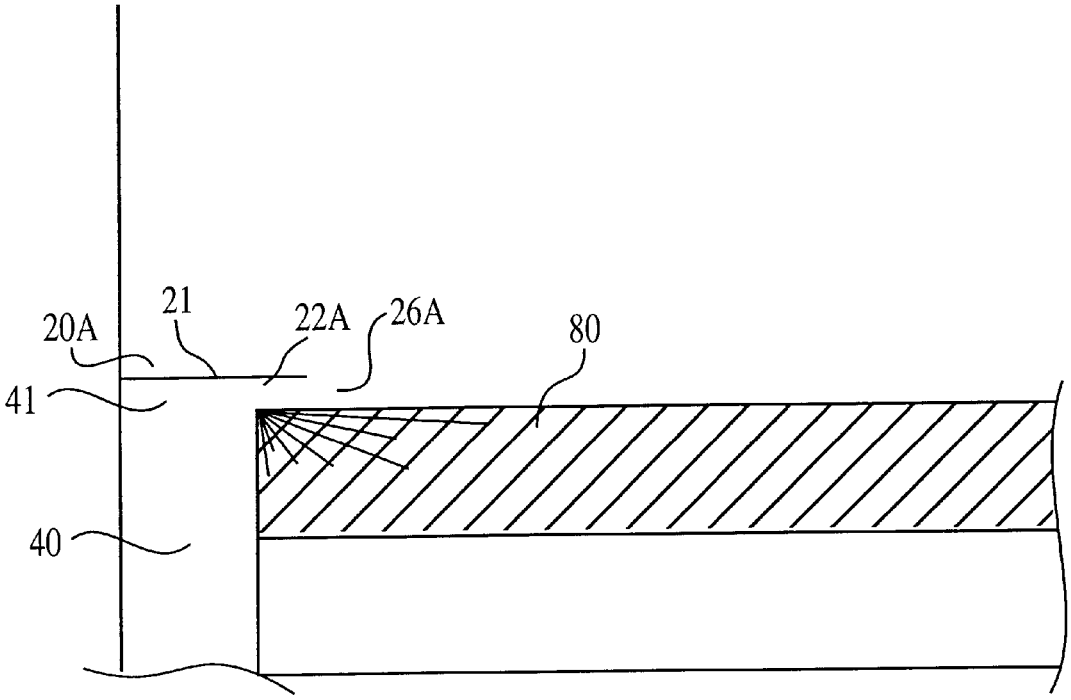

As depicted in FIG. 2C, an alternative ventilation device 20*a* is covering material 21. For example, covering material 21 may comprise a thin material that covers ends 41 of air flow shaft 40, such as a plastic material or other suitable material. The distance between covering material 21 and top layer 80 provides a ventilation shaft 22*a* and the end of covering material 21 provides an aperture 26*a*.

Figure 2D:
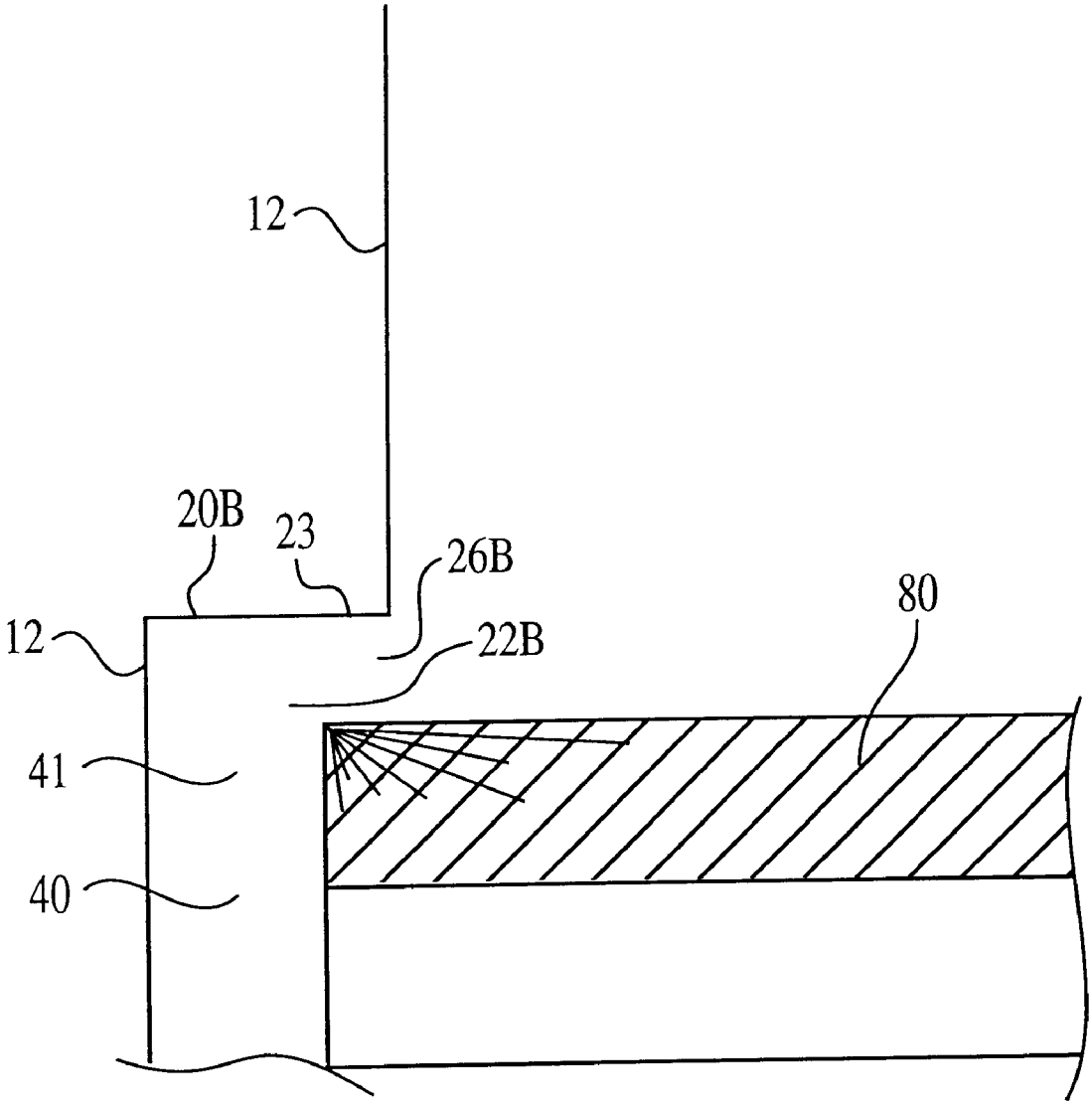
Figure 2E:
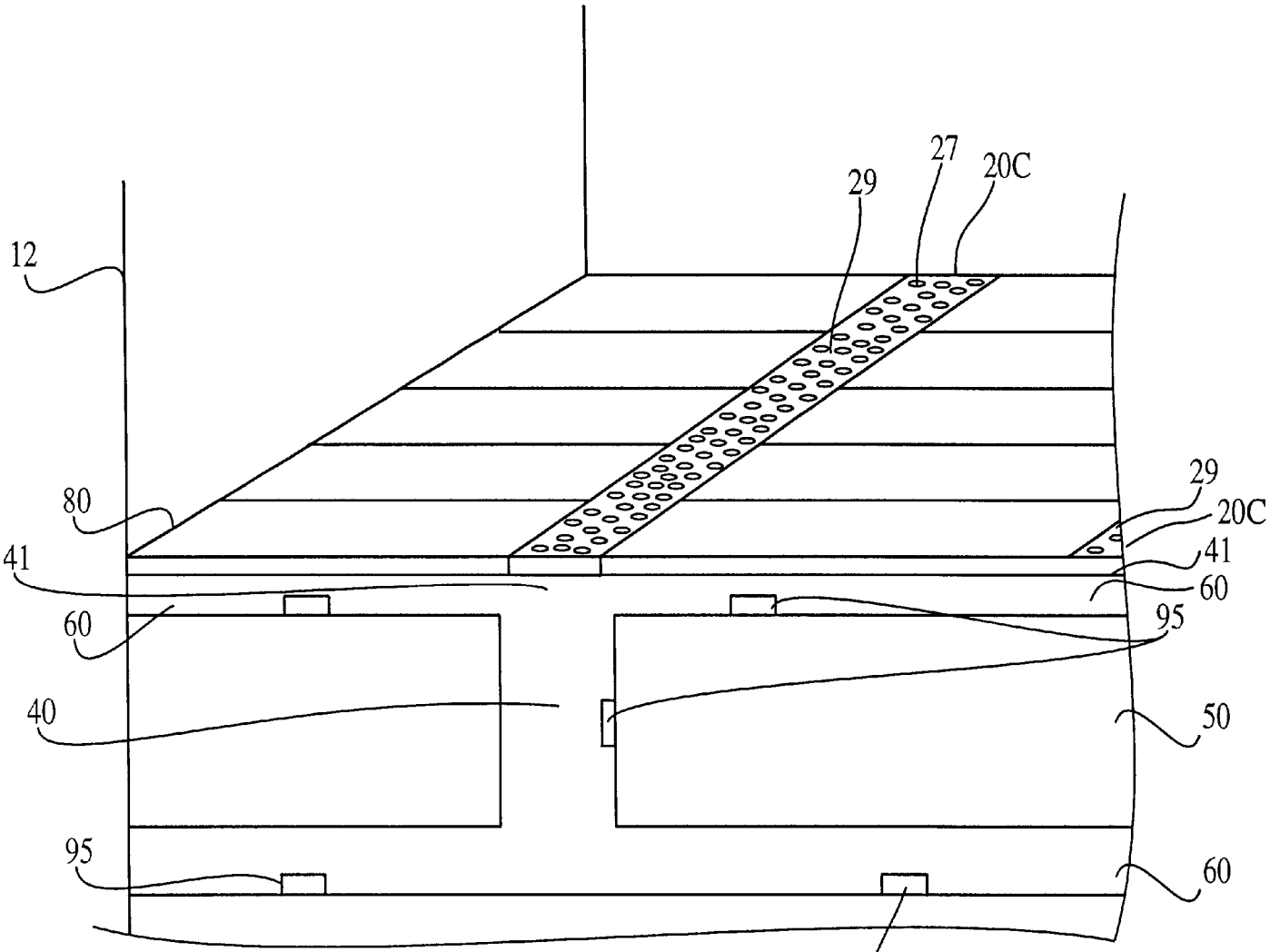

As depicted in FIG. 2D, another alternative ventilation device 20*b* is covering device 23. Covering device 23 may be part of wall 12. Covering device 23 covers ends 41 of air flow shaft 40. The distance between covering device 23 and ends 41 of air flow shaft 40 provides a ventilation shaft 22*b* and the end of covering device 23 provides an aperture 26*b*. This alleviates the need for separate ventilation devices 20. Additionally, aperture 26*b* may be, for example, an inch or less in size. However, it may be desirable that aperture 26*b* be small enough to prevent most debris from being pushed into air flow shaft 40, yet still large enough to allow air to flow through ventilation device 20*b*.

As depicted in FIG. 2E, another alternative ventilation device 20*c* could be a board 27 with small openings 29. Small openings 29 provide small apertures in ventilation device 20*c*. Board 27 could be placed anywhere in top layer 80 and could be perpendicular or parallel to boards that make up top layer 80. Air flow shaft 40 could be formed anywhere within the flooring system, as depicted. Additionally, ventilation layer 60 could be directly below top layer 80 and also below support layer 50, allowing board 27 to be placed in any convenient location. Ventilation device 20*c* allows air to flow through and out its small openings 29, and also prevents most debris from falling into ends 41 of air floor shaft 40. Alternatively, small openings 29 could be bore directly into top layer 80, such that ventilation device 20*c* would comprise small openings 29 in top layer 80. Small openings 29 would be apertures that let air flow out of flooring system 10. Alternatively, all of top layer 80 could have ventilation device 20*c* built directly into top layer 80 by having all of top layer 80 have small openings 29 that allow air to flow out of flooring system 10.

Ventilation device 20*c* is useful when a large amount of area is desired for air flow passage such as underneath bleachers in a gymnasium. Ventilation device 20*c* with small openings 29 is structurally sound, so ventilation devices 20*c* could be used throughout all of top layer 80. An example of ventilation device 20*c* includes a plurality of boards 27 joined together, each board 27 having multiple ¼ inch small openings 29 placed ½ inch apart.

Alternatively still, ventilation device 20 may be a mesh covering for end 41 of air flow shaft 40. The mesh covering may be a netting, a screen, or other similar covering that has a plurality of holes or apertures, to allow for air transfer and flow, yet covers end 41 to help prevent debris from falling into end 41. Any type of mesh or netting could thus be used as ventilation device 20. The mesh covering could be used as ventilation device 20 regardless of the location of end 41 of air flow shaft 40.

Alternatively still, ventilation device 20 may be a porous fabric, such as a carpet, rug, mat, foam, or other porous fabric. The porous fabric could allow for air transfer and flow through ventilation device 20, yet covers end 41 of air flow shaft 40 to help prevent debris from falling into end 41. Any type of porous fabric that allowed air to flow through it could thus be used as ventilation device 20. The porous fabric could be used as ventilation device 20 regardless of the location of end 41 of air flow shaft 40. This would allow the system to be used under a carpeted flooring, such as a carpeted basement, residential room, or office. Further, if, for example, ventilation device 20 was a carpet, when air was ventilated out through the carpet, it would also dry out the carpet if it was damp or wet.

Alternatively still, ventilation device 20 does not have to be placed above the top surface 30 of top layer 80. For example, if the flooring system were on a second floor, the system could ventilate out the bottom of flooring system 10 and through the ceiling of the first floor. In such an instance, the ventilation device would be below the flooring system. Alternatively still, ventilation device 20 could be outside of flooring system 10, such that air flow shaft 40 allows air to travel some distance away, with ventilation device 20 above end 41 of air flow shaft 40 and allowing the air to expel outside the system. For example, ventilation device 20 could be at end 41 of air flow shaft 40 some predetermined distance from top layer 80 and the building. Any of the ventilation devices 20 described herein, or any combination of these, can be used anywhere ventilation devices 20 are desired.

Referring again to FIG. 1, support layer 50 may comprise any material deemed appropriate to withstand the rigors of expansion, contraction and depressions from above or laterally. Support material 50 may be, for example, comprised of CDX plywood, fir or maple, and of a size and thickness deemed appropriate for the intended use. Support layer 50 does not have to be parallel to top layer 80. For example, it could alternatively be layered at a 45° angle to top layer 80, or perpendicular to top layer 80. Support layer 50 could also be made of boards of plywood. No spaces are needed between the boards in support layer 50, but such spaces might be used to assist in construction and prevent rubbing between the boards.

Support layer 50 could be placed a short distance from walls 12 or vertical obstructions, for example, a distance of about two inches. This distances creates an air flow shaft 40 between support layer 50 and walls 12 or vertical obstructions. Air flow shaft 40 can be comprised of one shaft adjacent to walls 12 around the entire perimeter of top layer 80 or broken into multiple air flow shafts 40 such as, for example, one around the perimeter of top layer 80 and others around vertical obstructions. Alternatively, air flow shaft 40 can be in any location throughout the flooring system 10, i.e., air flow shafts 40 do not have to be adjacent to walls 12. For example, air flow shaft 40 can be a predetermined distance from walls 12, for example, near the middle of the floor.

Air flow shafts 40 can be two inches wide or any other appropriate distance for the particular flooring being used. The width of air flow shaft 40 can be any size that the elements of flooring permit. For example, the width of air flow shaft 40 is generally in the range of from a fraction of an inch to 5 inches or larger, but is preferably in the range of ½ to 3 inches, and more preferably is 2 inches.

Air flow shafts 40 allow air to travel through ventilation layer 60 and into ventilation devices 20. While air travels through ventilation layer 60 and through air flow shafts 40, environmental conditions such as temperature and humidity can be regulated such as, for example, by increasing or decreasing air movement. Further, the air flow helps to remove moisture in the system created by slab migration, water leaks or other problems, and accelerates the drying out process.

Ventilation layer 60 comprises air channels 42 divided by spacers 62. Spacers 62 can be any size or resiliency deemed necessary for the desired use. For example, spacers 62 may be made of solid spacers, foam spacers, wood, rubber or another conventional material. Spacers 62 can also be pads that are placed on the underside of support layer 50 for protection of support layer 50 in addition to defining ventilation layer 60. Alternatively, spacers 62 may be long boards spaced apart so as to provide air channels 42. Spacers 62 can allow for at least some resiliency or cushion in flooring system 10. Spacers 62 may also be at any angle with respect to support layer 50, or fill the entire ventilation layer 60, if necessary. Spacers 62 could also be in a zig-zagged pattern as depicted in FIG. 1. Alternatively, spacers 62 can be an entire sheet of foam which is either zig-zagged, crisscrossed or prepared in another pattern, or contain air channels 42 within the foam. Spacers 62 support the above support layer 50 and any other layers that may be above.

Ventilation layer 60 may be about ¼ inch thick or, alternatively, any size deemed appropriate to allow for air movement. Ventilation layer 60 should be of a size to permit sufficient air to ventilate through the layer. As the width and length of spacers 62 are increased, the size of air channel 42 is decreased. Alternatively, as the thickness of spacers 62 is increased, the air space between flooring base 70 and support layer 50 is increased. Alternatively, ventilation layer 60 could be directly below top layer 80 such as is shown in FIG. 2E.

Figure 3:
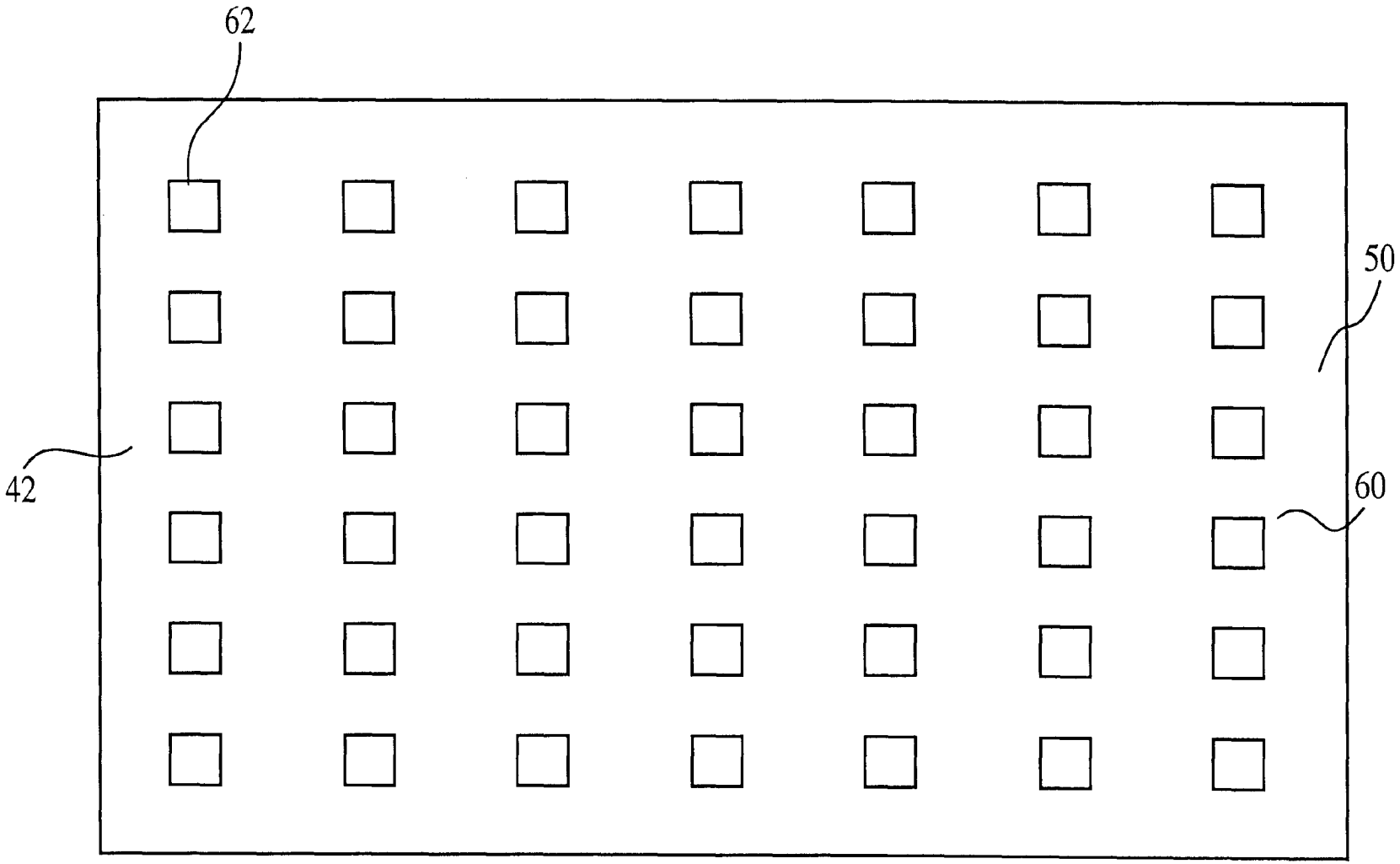
FIG. 3 Drawing of a plan view of the underside of a support layer.

FIG. 3 depicts a drawing of a plan view of the underside of support layer 50 of an aerated flooring system. As depicted, spacers 62 may be placed intermittently throughout ventilation layer 60. By having smaller individual spacers 62, a larger air channel 42 is created.

Figure 4:
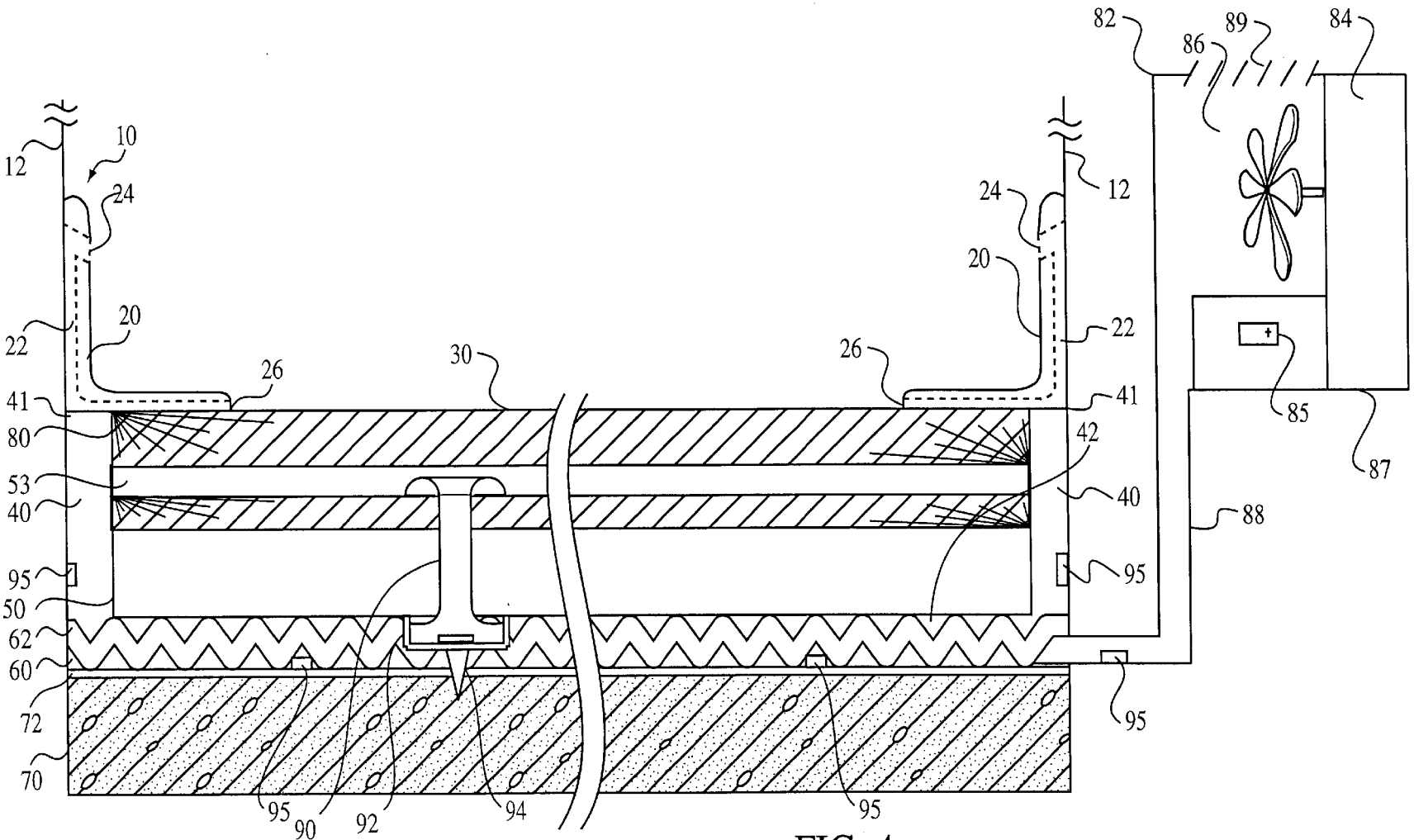
FIG. 4 Drawing of a side view of a flooring system.

FIG. 4 depicts a drawing of a side view of an aerated flooring system. This view is similar to FIG. 1 except that clip 90 connects spacers 62 via groove 53 to top layer 80. Groove 53 is cut into top layer 80 and provides a ledge for clip 90 to connect. Groove 53 may, alternatively, be a tongue that extends outward from top layer 80 for clip 90 to connect. Clip 90 can be made of any material such as, for example, metal or hard plastic, and of any size appropriate for ventilation layer 60 and flooring system 10 to hold spacers 62 in place. A clip channel 92 runs across the flooring system. Clip channel 92 is used to hold the multiple clips 90 in place. Clip channel 92 can be made of any material of any strength, size or shape that can hold clip 90 in place such as metal or plastic. Clip 90 connects to base 70 with an anchor 94. Anchor 94 can alternatively go through spacer 62. Anchor 94 can be a metal or wood nail, or any material of any size and strength necessary to hold spacer 62 in place. Clip 90 is especially useful for zig-zagged spacers 62, as depicted in FIGS. 1 and 4. Thus, clip 90 helps keep top layer 80 and spacer 62 together, being affixed to base 70. Alternatively, support layer 50 can also be used, as depicted. In such an instance, clip 90 helps keep top layer 80, support layer 50, and spacer 62 together, being affixed to base 70. Alternatively still, channel 92 can have a support material, such as a wood strip, running through channel 92, allowing top layer 80 to be nailed directly to the support material without using clip 90.

Vapor barrier 72 can be placed above base 70, and preferably between ventilation layer 60 and base 70. Vapor barrier 72 is a barrier that prevents moisture from getting through to base 70 or up from base 70. Vapor barrier 72 is preferably composed of a materials such as, for example, Visqueen. Alternatively, vapor barrier 72 could be a small 6 millimeter thick layer of plastic or polyethylene. Alternatively still, any material that helps to prevent moisture from seeping through to base 70 could be used. Alternatively, vapor barrier 72 could be any water-proof, insulating fiberglass sheet, such as Mondo EVERLAY. Mondo EVERLAY has multiple vinyl foam nubs which create air pockets. These air pockets can be used to create a ventilation layer 60 between vapor barrier 72 and base 70. Alternatively, vapor barrier 72 could also help facilitate attachment of other layers to vapor barrier 72. Base 70 comprises any matter deemed sturdy enough to hold up the activities that are performed on top of flooring system 10. For example, base 70 could be concrete or another rigid material that is capable of supporting flooring system 10.

The multiple materials and layers can be kept together with any suitable material, such as adhesive, staples, screws, tacks, nails, snaps, hooks or other conventional connecting means. Alternatively, all the layers could be held together with devices similar to clip 90.

Blowing device 82 causes air to flow through flooring system 10 by either blowing or sucking air out of flooring system 10. Blowing device 82 can be any device capable of causing an air turbulence in a flooring system such as, for example, a fan, a blower, a device to force air, any other type of air movement device or any combination of such devices. Blowing device 82 comprises an air movement device 86, such as fan blades, and a motor. Blowing device can be housed in housing 87.

Blowing device 82 can also be connected to automated system 84 to monitor the flooring system. Automated system 84 could also be housed in housing 87 and may be locked by lock 85. A convenient location for blowing device 82 could be under a bleacher, in a closet or outside of the room or area of the flooring. Ambient air can be sucked in or blown out from vents 89. Blowing device 82 can be anywhere that it has access to ambient air to cause air flow. Further, blowing device 82 can be located in any location where a conventional fan or blowing unit could be located. Additionally, blowing device 82 can connect into ventilation layer 60 at any convenient location through air flow shaft 40 or through a discharge hole 83, as depicted in FIG. 8.

Figure 8:
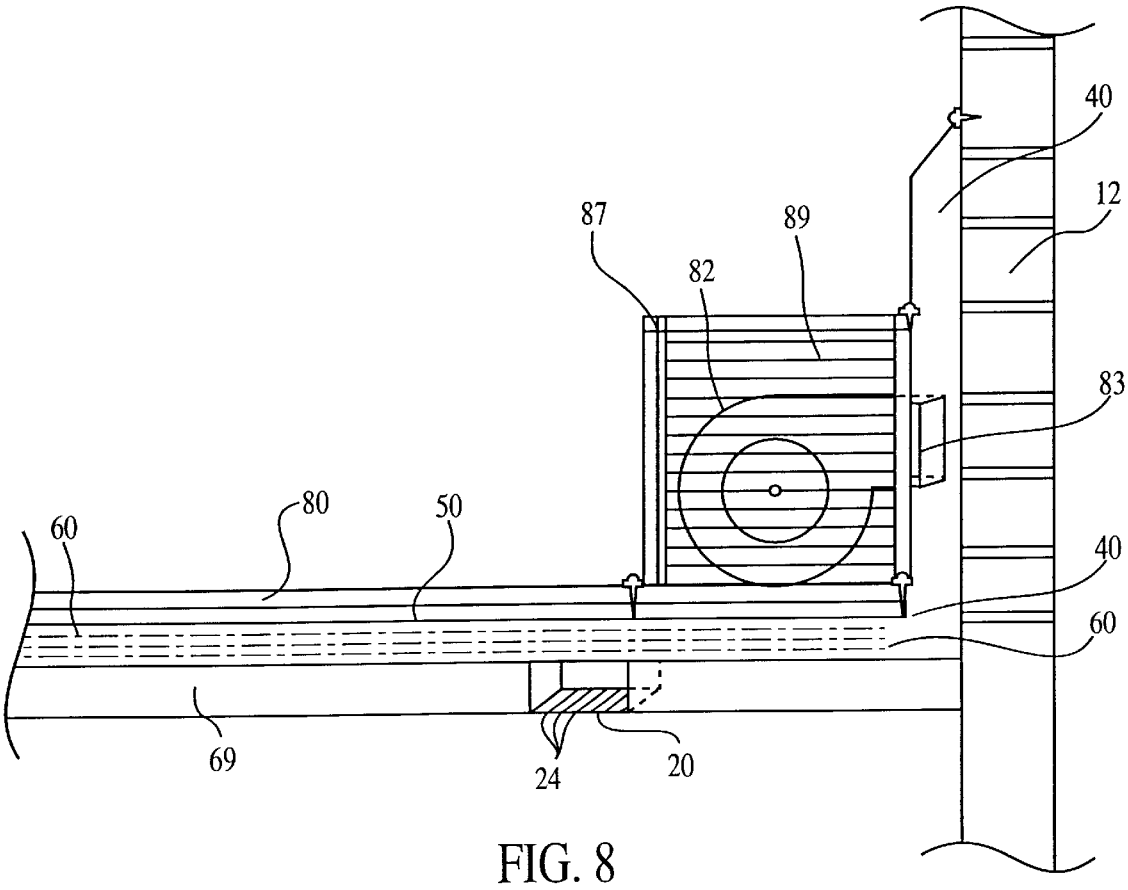
FIG. 8 Drawing of a blowing device.

As depicted in FIG. 8, blowing device 82 and housing 87 can be above top layer 80. Additionally, discharge hole 83 can be within air flow shaft 40, and air flow shaft 40 can also extend above top layer 80. Housing device 87 can be connected to top layer 80 by any connecting means, such as nails. Any number of blowing devices 82 can be used. Using multiple blowing devices 82 allows the system to adjust environmental conditions in only the areas that require adjusting. Further, the flooring system could use a humidifier or dehumidifier in connection with blowing device 82 or, alternatively, a blowing device 82 having a humidifier or dehumidifier.

Automated system 84 can comprise one or more computers linked to one or more humidistats to detect humidity levels. Computers can be functionally connected to operate blower devices to respond, as desired, to changes in humidity levels. Blowing device 82 can therefor be automated, providing twenty-four hour monitoring, on the hour readings, temperature readings above and below the flooring, manual override and codes to only allow access to only certain users (security controls). Such security controls are known to those of ordinary skill and commercially available. Additionally, blowing device 82 could be filtered with conventional filters. Connection tube 88 allows blowing device 82 to be some distance from ventilation layer 60. If blowing device 82 is some distance from ventilation layer 60, automated system 84 might be placed in a closer location for ease of monitoring.

Automated system 84 can regulate the blowing device and the environmental conditions in the room, and below and throughout the system, directly above the floor and in the entire building. Automated system 84 can accurately and efficiently monitor temperature, humidity, moisture and other environmental conditions, using computers and monitoring devices such as sensors. Twenty-four hour monitoring can observe the system in addition to providing alarms to indicate malfunctions or undesirable environmental conditions. The alarm, which may respond to sensors that detect a variety of different or the same environmental conditions, may be only audible, only visible, or a combination of visible and audible alarms and, if desired, connected to local emergency offices such as fire or police, or to appropriate personnel. Further, alarms could contact appropriate service personnel via a beeper, Internet connection or automated telephone call. However, automated system 84 can be overridden and be operated using manual commands, i.e., inputting a specific desired temperature or humidity level, can also be entered by appropriate personnel. Thus, the system can either be controlled automatically or manually.

Additionally the system can be regulated to adjust according to the location of the system, as different parts of the country have different humidity and temperature constants. Moreover, automated system 84 can accommodate seasonal changes and/or unusual weather conditions. Based on historical data and data gathered from automated system 84, automated system 84 can be set up and programed to correctly control environmental conditions.

Automated system 84 can be controlled off-site. For example, one central location can control multiple automated systems for multiple flooring systems located anywhere in the world. A user at the central location could receive data from individual sensors 95 or data on the entire flooring system. The user can also control the blowing device 82 or any other devices flooring system uses. Information can be relayed to the central location via modem, Internet communication link, telephone or another communication means.

In addition, automated system 84 could control spraying devices to dispense insecticides, odor combatants, germicides, air freshening scents or any other chemicals to eliminate insects, odors or other unwanted conditions. When an undesirable condition is detected or the appropriate personal manually gives a command to automated system 84, the spraying devices are activated. The spray could be introduced near blowing device 82, thus allowing the spray to disperse through the system. For example, if an air freshening scent were sprayed, blowing device 82 could disperse the air freshening scent through the system and out through ventilation devices 20. Thus, users above flooring system 10 could smell these freshening scents.

Referring to FIG. 1, sensors 95 could be placed anywhere above and/or below the floor, or any other convenient location. For example, sensors 95 could be placed within ventilation layer 60, within air flow shaft 40, or any other desired location. Sensors 95 can be placed, for example, every twenty-five feet. Accordingly, sensors 95 can be placed in any location that is appropriate for the particular flooring system.

Sensors 95 relay information back to automated system 84 that regulates environmental conditions. Sensors 95 allow the system to centralize problem areas caused by any undesired environmental conditions. The more sensors 95 used, the more precise the location of any problem is known. Sensors can be any device that is capable of detecting environmental conditions, for example a humidistat, temperature gauge, or moisture probe. Sensors 95 are connected to automated system 84 via electrical wiring to a power source such as a battery or a central electrical supply.

Sensors 95 allow the system to adjust for different conditions. For example, the system can monitor air about to be blown into the flooring system to prevent humid air from being blown into flooring system.

Automated system 84 can run periodic tests to determine the conditions of the flooring system. These tests can occur between preset intervals or randomly chosen. During tests, automated system 84 can obtain data from sensors 95 and adjust the temperature, humidity, and moisture level within the flooring system to a predetermined, desired condition. Alternatively, automated system 84 could continuously read data from sensors 95 and adjust the environmental conditions when necessary.

In addition to blowing device 82, automated system 84 can use various devices to maintain desired environmental conditions. These devices can include, but are not limited to: humidifiers, dehumidifiers, air conditioners, heaters, exhaust fans, lighting, modems, other environmental regulation mechanisms and combinations thereof. These other devices can be connected to blowing device 82, be in housing 87, or be in different locations throughout the building.

Besides keeping the moisture in flooring system 10 regulated, the air flow from blowing device 82 helps keep support layer 50 and top layer 80 dry by percolating dry air up through and across support layer 50 and top layer 80, through pores in the two layers. Thus, the environmental conditions below and within the flooring system are regulated.

Figure 5:
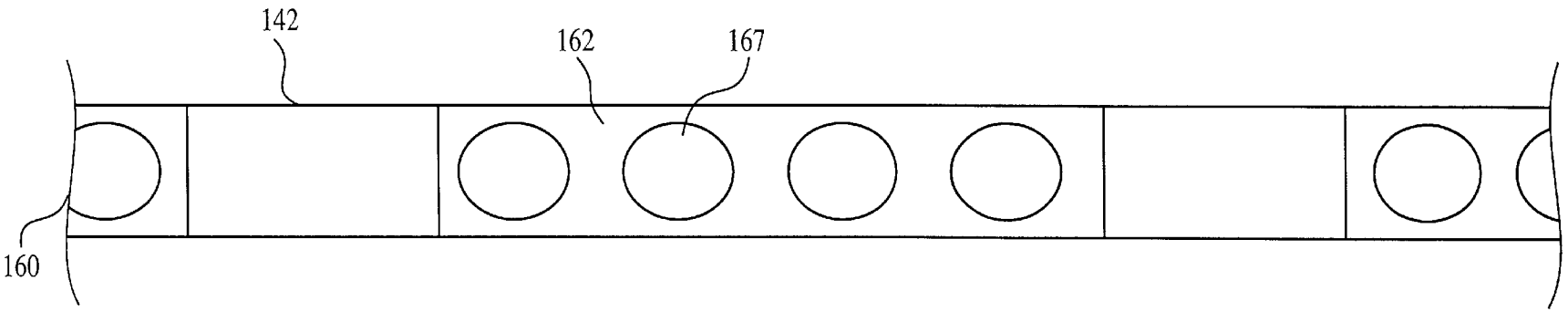
FIG. 5 Drawing of a ventilation layer.

In another embodiment of the present invention, a different ventilation layer 160 can be used as depicted in FIG. 5. Ventilation layer 160 is similar to ventilation layer 60 and includes spacers 162 and air channels 142. Spacers 162 have air holes 167 that allow for air flow. Accordingly spacers 162 can be individual pads, intermittent strips or extend throughout the entire ventilation layer such as, for example, with a large foam spacer 162. Ventilation layer 160 can be used in connection with any other embodiment described herein.

Figure 6:
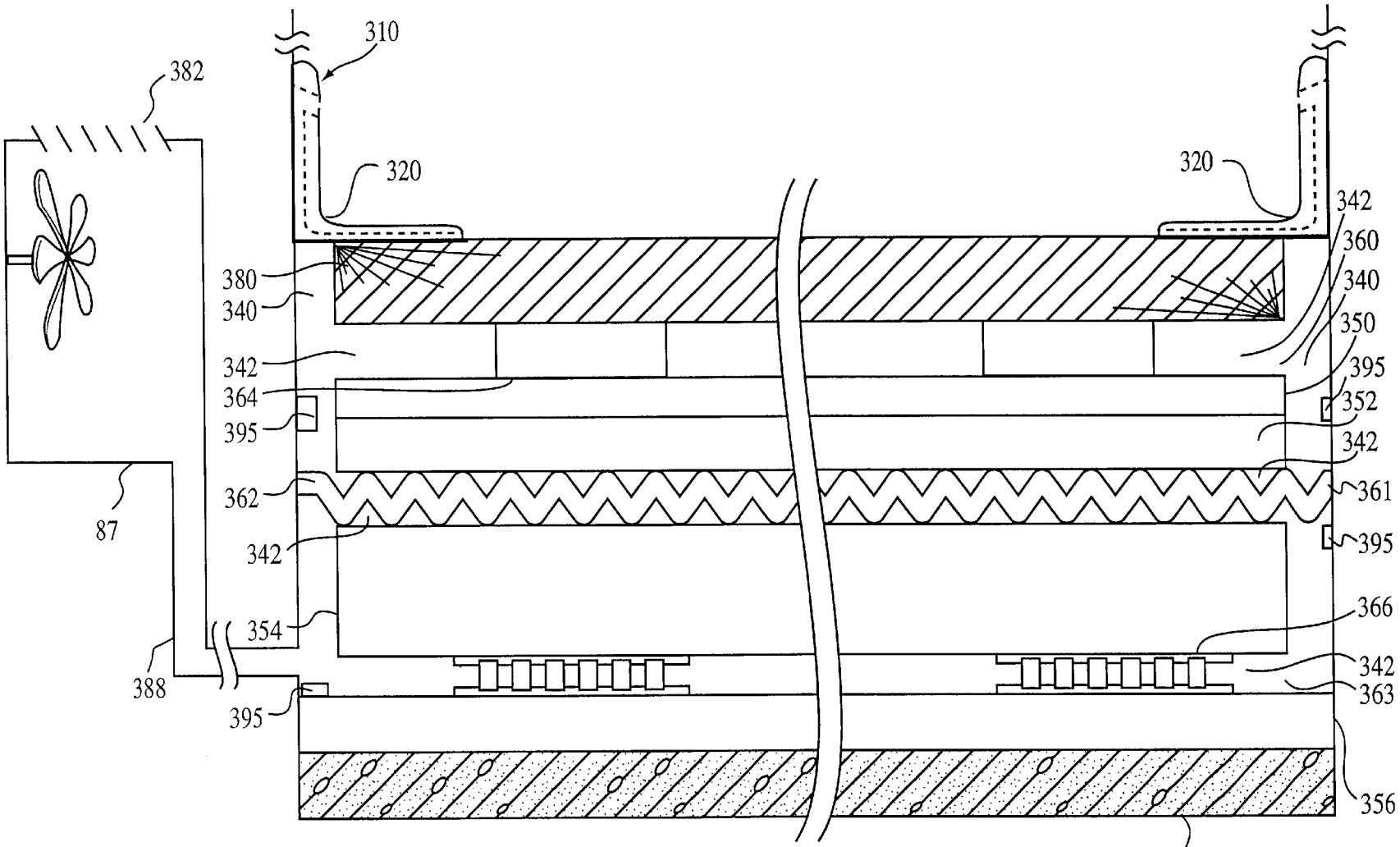
FIG. 6 Drawing of a side view of a flooring system with multiple ventilation layers and support layers.

In another embodiment of the present invention, a flooring system 310 with multiple ventilation layers 360, 361, and 363 and multiple support layers 350, 352, 354, and 356 can be used as depicted in FIG. 6. Top layer 380, base 370, ventilation devices 320, connector 388, blower 382 and sensors 395 are all similar to their corresponding parts in flooring system 10. In this embodiment, multiple ventilation layers 360, 361 and 363 exist to help further facilitate air flow. While various spacers 362, 364 and 366 are depicted, ventilation layers 360, 361 and 363 can include any combination of spacers 362, 364 and 366 or other spacers herein disclosed. Further, although three ventilation layers 360, 361 and 363 are depicted, flooring system 310 can include any number of ventilation layers. Moreover, ventilation layer 360 could be placed above support layer 350 and below top layer 380, as depicted.

In ventilation layer 360, spacers 364 are placed intermittently through ventilation layer 360 creating air channels 342. Ventilation layer 360 may be similar to ventilation layer 60 depicted in FIGS. 1 and 3. Alternatively, spacers 364 may be intermittently placed strips, within ventilation layer 360, that extend the distance across flooring system 310 and either perpendicular, parallel or at some offset angle to top layer 380. These strips may be attached to the top or bottom of the layer immediately below or above ventilation layer 360.

As depicted in FIG. 1, various spacers can be used in ventilation layer 361 using, for example, spacers in a zigzagged pattern 362 which are similar to spacers 62. In ventilation layer 363, spacers 366 are used. Spacers 363 provide additional support to support layer 354.

As also depicted in FIG. 6, multiple support layers can be placed intermittently between base 370 and top layer 380. Additionally, support layers can be on top of one another, such as with support layers 350 and 352. The multiple support layers 350, 352, 354 and 356 may, for example, be ½ inch CDX plywood layers. Support layers 350, 352, 354 and 356 are similar to support layer 50 of flooring system 10. Alternatively, there can be any number of support layers and in any location. For example, support layer 356 can be placed directly above base 370 and below ventilation layer 363. Spacers 366 can thus also be connected directly to support layer 356.

The multiple support layers and multiple ventilation layers could be placed in any combination and in any number between top layer 80 and base 70. The multiple support layers and ventilation layers depicted in FIG. 6 can be used in connection with any other embodiment described herein.

Some examples of possible combinations of different layers in the flooring system can include a top layer with ventilation devices, a first support layer, a ventilation layer and a base. Alternatively, the system can include (i) a top layer with ventilation devices, a first support layer, a second support layer, a ventilation layer and a base; (ii) a top layer, multiple support layers, a ventilation layer, and a base; (iii) a top layer, a support layer, a ventilation layer connected by a clip or nail to the support layer and a base; (iv) a top layer with ventilation devices, multiple support layers, a ventilation layer and a base; (v) a top floor layer with ventilation devices, a first support layer, a first ventilation layer, a second support layer, a second ventilation layer, and a base; (vi) a top layer with ventilation devices, a first ventilation layer, a first support layer, a second ventilation layer, a second support layer, a third ventilation layer and a base; or (vii) a plurality of ventilation layers and/or support layers.

Figure 7A:
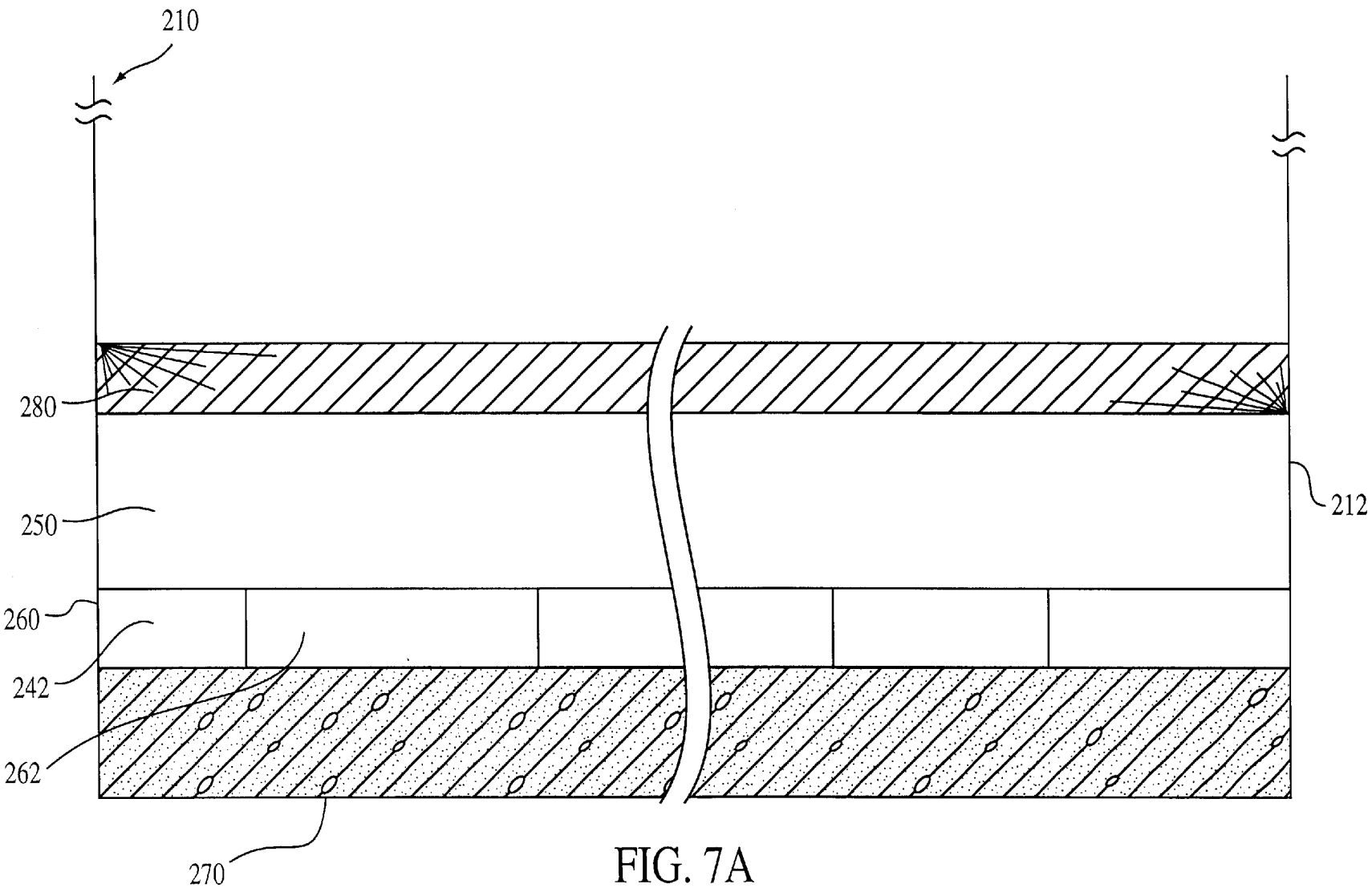
FIG. 7 Drawings of (A) a side view of a flooring system, (B) with air flow shafts, (C) with a blowing device and sensors, and (D) with ventilation devices.

To create an aerated flooring system, it may often be easiest to adapt an existing flooring system, as depicted in FIGS. 7A to 7D. This is less expensive then removing the old flooring system and constructing the aerated flooring system. To accomplish this, one starts with a existing flooring system 210 as depicted in FIG. 7A. While most conventional flooring systems can be easily modified, flooring systems that are iron bound or have the top layer directly glued to the base could be more difficult or impossible to modify.

It is preferable that the existing flooring system 210 has some type of ventilation layer 260. Ventilation layer 260 can be any layer that is capable of allowing air to flow some distance through it. If the existing system does not have a ventilation layer 260 of some sort, a ventilation layer 260 has to be first added to the conventional flooring system. In this example, existing flooring system 210 has a top layer 280, a support layer 250, and a ventilation layer 260 with some type of spacers 262 and air channels 242. Also, flooring system 210 has a base 270 and walls 212.

Figure 7B:
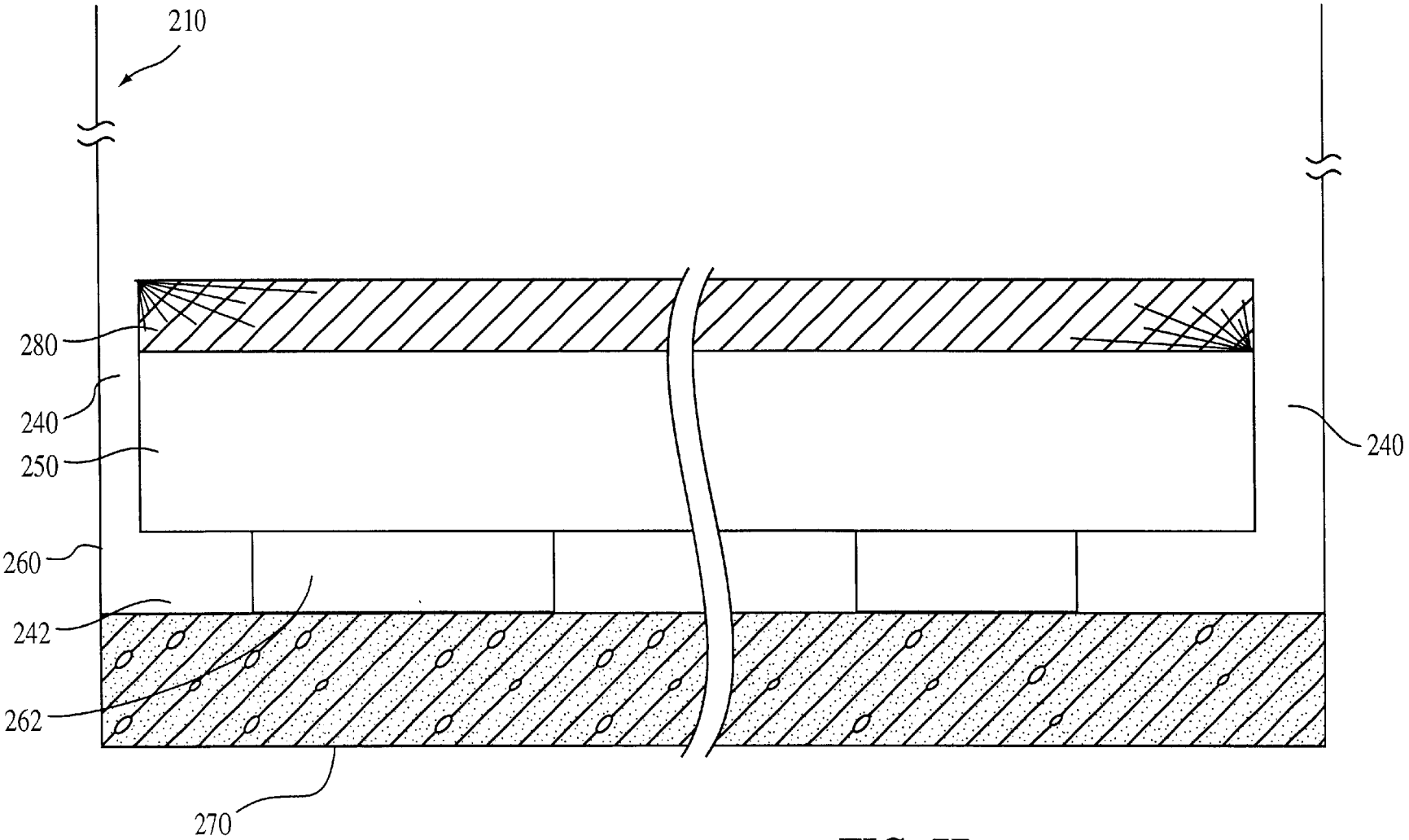

To adapt existing flooring system 210 to one of an aerated flooring system, air flow shafts 240 are added to the current flooring system 210, as depicted in FIG. 7B. Air flow shafts 240 are added by digging or cutting out a short distance from wall 212 down to at least one ventilation layer 260. For example, air flow shafts can be dug or cut such that they extend two inches from wall 212. Air flow shafts 240 are similar to air flow shafts 40.

Figure 7C:
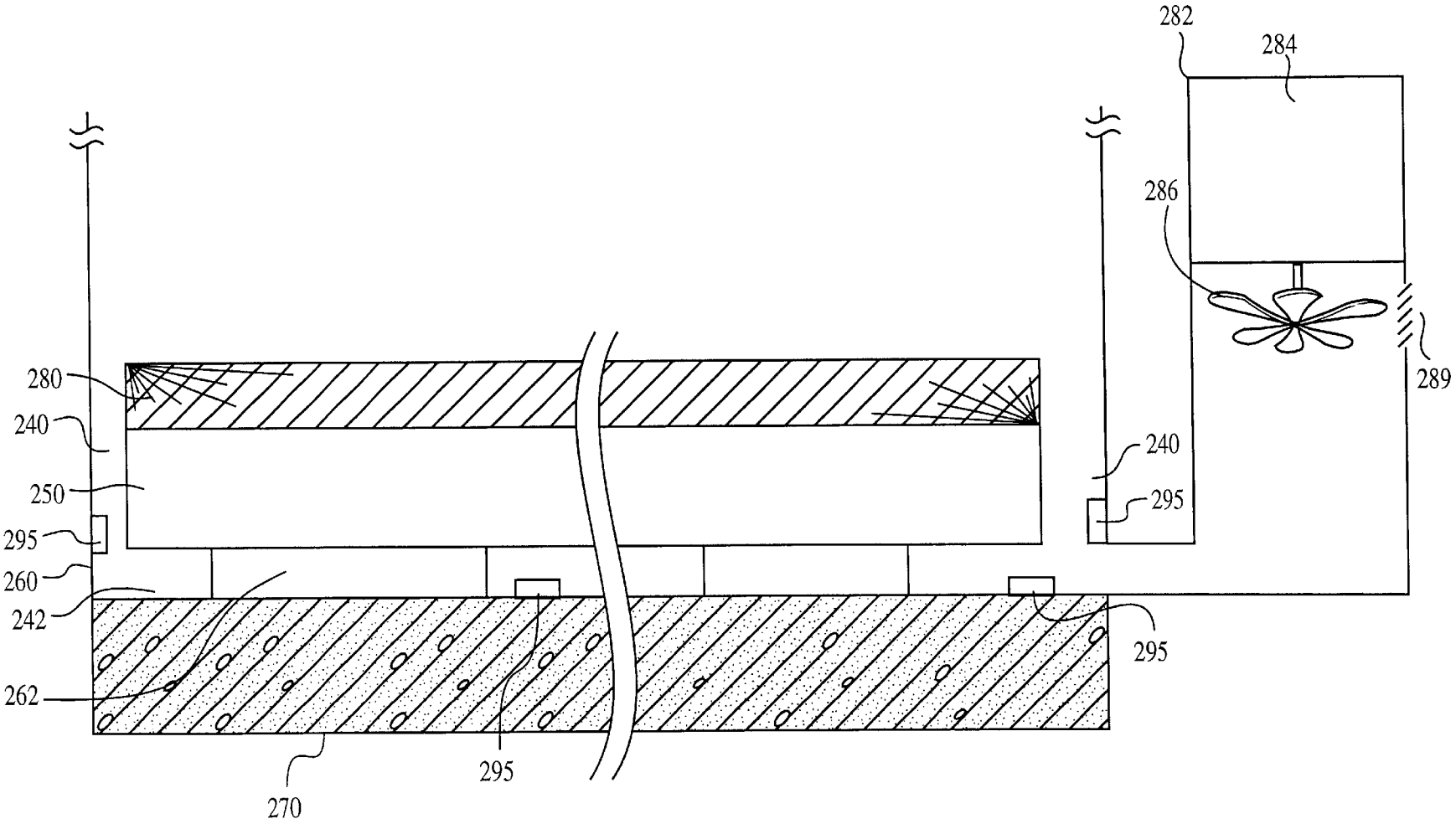

A blowing device 282 and sensors 295 are added, as depicted in FIG. 7C. Blowing device 282 can include blades 286, a motor and use vents 289. Blowing device 282 is similar to blowing device 82 and sensors 295 are similar to sensors 95. Additionally, blowing device 282 can house an automated system 284. Accordingly, other computing equipment and additional regulating devices, such as humidifiers, can also be added, similar to flooring system 10. Blowing device 282 can be placed some distance from ventilation layer 260 with a connector similar to connector 88. A convenient location could be under a bleacher, in a closet or outside, similar to blowing device 82. Additionally, flooring system 210 can be fitted with any number of blowing devices 282.

Figure 7D:
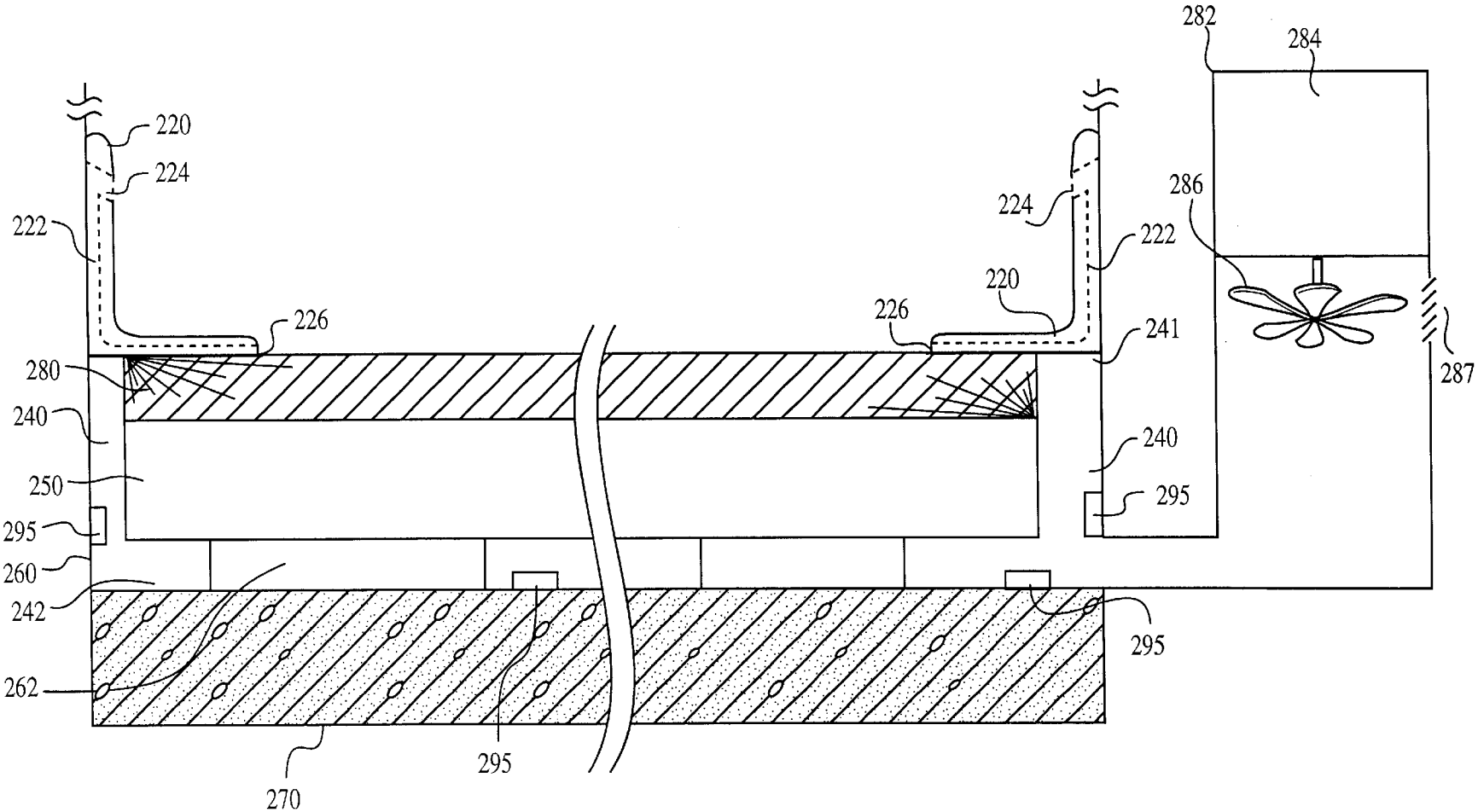

Ventilation devices 220 are placed over air flow shafts 240 at end 241 of air flow shafts 240 as depicted in FIG. 7D. Ventilation devices 220 are similar to ventilation devices 20, 20*a*, 20*b* and 20*c*, and include ventilation shafts 222 and air flow apertures 224 and 226. Like ventilation devices 20, ventilation devices 220 can be any device that facilitates air release and helps to prevent debris or other material from falling into the openings in the top layer of the floor. Thus, a conventional flooring system can be converted to an aerated flooring system of this invention.

The following examples illustrate embodiments of the invention, but should not be viewed as limiting the scope of the invention.

EXAMPLE

A method of making an aerated flooring system can be accomplished by way of the following example. A concrete base 70 is created by laying a slab of concrete. Concrete base 70 is covered with a vapor barrier 72, such as 6 millimeter polyethylene. A suitable position for blowing device 82 is determined and, if needed, a closet or other location could be prepared for blowing device 82. Housing 87 for blowing device is built along with connector 88. Blowing device 87 is inserted into housing 87. Support layer 50 can be made of individual boards of plywood. Then, ¼ inch spacer strips 62 are placed on the underside of support layer 50. Alternatively a foam spacer in a zig-zagged pattern 62 is placed above base 70 to create ventilation layer 60. An approximately ¼ inch space is left at the ends and sides of the boards of plywood of support layer 50. A two inch expansion void between support layer 50 and walls and vertical obstructions is also maintained. The ¼ inch spaces are for construction purpose and prevent rubbing between the boards. The two inch expansion voids create air flow shaft 40. Then, top layer 80 is connected to support layer 50. Top layer 80, can be made of wood, and can have ventilation devices 20 placed on the top surface 30 of top layer 80. Any one of the ventilation devices, 20, 20*a*, 20*b*, or 20*c*, can be placed above top layer 80.

In operation, blowing device 82 can regulate environmental conditions, such as temperature moisture, and humidity, above, below, and within flooring system 10. When required, air can be blown into the system, via blowing device 82. Air is blown in or out of the system through ventilation layer 60. This helps regulate temperature, moisture and humidity below the flooring and of support layer 50 directly above it, helping to control the moisture in flooring system 10. After circulating through ventilation layer 60, air travels up the edges of support layer 50, through air flow shafts 40. Air then travels through ends 41 of air flow shafts 40 and into ventilation devices 20. In ventilation devices 20, air travels through ventilation shafts 22, then out through air flow apertures 24 and 26.

Other embodiments and uses of the invention will be apparent to those skilled in the art from consideration of the specification and practice of the invention disclosed herein. All U.S. patents and patent applications, including provisional applications, and all other documents referenced herein, for whatever reason, are specifically incorporated by reference. This application is based on, and claims priority from, U.S. Provisional Application Ser. No. 60/076,708, and is herein incorporated by reference. It is intended that the specification and examples be considered exemplary only, with the true scope and spirit of the invention indicated by the following claims.

I claim:

1. A vented cove flooring base comprising:

an upstanding planar element, a ventilation shaft disposed on a back-side of said upstanding planar element and extending from a bottom end to a position below a top end of said upstanding planar element, said ventilation shaft being at least a size to allow for air to travel;

an air flow aperture, said air flow aperture operable to release air, wherein said air flow aperture is directed in a direction such as to help prevent debris from falling into said flow aperture; and wherein said vented cove base is substantially L-shaped.

2. A flooring system comprising:

a ventilation device comprising said vented cove base of claim 1;

a top layer of flooring;

a ventilation layer below said top layer, the ventilation layer being at least a size to allow for air to travel; and an air flow shaft that allows said air to travel from said ventilation layer to said at least one ventilation device, whereby said ventilation device is placed at an end of said air flow shaft to prevent debris from entering said air flow shaft.

3. The flooring system of claim 2, further comprising:

a blowing device connected to said ventilation layer, whereby said blowing device is adapted to circulate said air through said ventilation layer, then through said air flow shaft, then through said ventilation device, and the out said air flow aperture.

4. The vented cove base of claim 1, wherein said vented cove base consists of a single member.

5. The vented cove base of claim 4, wherein said air flow aperture is formed by excluding a portion of said member.

6. The vented cove base of claim 1, wherein said air flow aperture is formed on an upper part of said base and is directed downward.

7. The vented cove base of claim 1, further comprising a plurality of air flow apertures, wherein said plurality of apertures are directed in a direction such as to help prevent debris from falling into said plurality of air flow apertures.

8. A vented cove base comprising:

an upstanding planar element;

a base element disposed on a bottom end of said upstanding planar clement and extending therefrom on a front-side of said upstanding planar element;

a first air channel disposed on a back-side of said upstanding planar element, said first air channel extending from said bottom end to a position below a top end of said upstanding planar element; and, an air flow aperture disposed on said upstanding planar clement and connected to said first air channel, wherein said air flow aperture is directed to help prevent debris from entering into said air flow aperture.

9. The vented cove base of claim 8, further comprising a second air flow channel disposed on a bottom side of said base element, said second air flow channel extending from said bottom end of said upstanding planar element to a distant end of said base element.

10. The vented cove base of claim 8, wherein said air flow aperture is directed downward.

11. The vented cove base of claim 10, wherein said air flow aperture is disposed on the upper half of said upstanding planar element.

12. The vented cove base of claim 8, further comprising a plurality of air flow apertures, wherein said plurality of apertures are directed to help prevent debris from entering into said air flow aperture.

13. The vented cove base of claim 8, wherein said upstanding planar element is substantially perpendicular to said base element.

* * * * *